US009750997B2

(12) United States Patent
Frampton

(10) Patent No.: US 9,750,997 B2
(45) Date of Patent: Sep. 5, 2017

(54) UNDERHANDED PITCH TRAINING DEVICE

(71) Applicant: Mark Frampton, Pine City, NY (US)

(72) Inventor: Mark Frampton, Pine City, NY (US)

( * ) Notice: Subject to any disclaimer, the term of this patent is extended or adjusted under 35 U.S.C. 154(b) by 0 days.

(21) Appl. No.: 15/044,938

(22) Filed: Feb. 16, 2016

(65) Prior Publication Data

US 2016/0236053 A1 Aug. 18, 2016

Related U.S. Application Data

(60) Provisional application No. 62/116,076, filed on Feb. 13, 2015.

(51) Int. Cl.

*A63B 69/00* (2006.01)
*A63B 5/22* (2006.01)
*A63B 102/18* (2015.01)

(52) U.S. Cl.

CPC ..... *A63B 69/0002* (2013.01); *A63B 5/22* (2013.01); *A63B 2069/0006* (2013.01); *A63B 2069/0062* (2013.01); *A63B 2102/182* (2015.10); *A63B 2210/50* (2013.01); *A63B 2225/09* (2013.01)

(58) Field of Classification Search

CPC . A63B 69/0002; A63B 5/22; A63B 2102/182; A63B 2069/0006; A63B 2069/0062; A63B 2210/50; A63B 2225/09

USPC ..... 473/452, 422, 451, 497, 218, 270, 272; D21/698, 780, 688, 717–719

See application file for complete search history.

(56) References Cited

U.S. PATENT DOCUMENTS 3,244,421 A * 4/1966 Hanna ..... A63B 69/3667 473/273
4,057,248 A * 11/1977 Stoecker ..... A63B 69/0002 473/451
5,000,449 A * 3/1991 Weeks ..... A63B 69/0002 473/452
5,058,889 A * 10/1991 Burton ..... A63B 69/0002 473/452
5,188,357 A * 2/1993 Barnum ..... A63B 69/0002 473/497
5,385,343 A * 1/1995 Davis, Sr. ..... A63B 69/0002 473/452
5,639,243 A * 6/1997 Ryan ..... A63B 69/0002 473/451
5,810,673 A * 9/1998 Castleberry ..... A63B 69/3673 473/217
6,102,818 A * 8/2000 Hamilton ..... A63B 69/0002 473/452

(Continued)

*Primary Examiner* — Mitra Aryanpour
(74) *Attorney, Agent, or Firm* — Vincent G. LoTemplo; Kloss, Stenger & LoTemplo; David T. Stephenson

(57) ABSTRACT

A pitching training device generally having a platform with a generally T-shaped end and a raised pitchers rubber configured to support the pitcher during delivery of the underhanded pitch, and a pair of removable heel guides to inhibit rotation of a drive foot of the pitcher. A stride section, removably connected to and positioned to extend longitudinally from said generally T-shaped end. A goal post assembly configured to movably position a stride bar across the stride section. The stride bar is positioned as a target for a drive foot of the pitcher to clear a predetermined height during the underhanded pitch. The device is lightweight and portable, useable indoors or on a practice field and is operable for left or right handed pitching.

18 Claims, 14 Drawing Sheets

(56) References Cited

U.S. PATENT DOCUMENTS 6,224,522 B1 * 5/2001 Ervin ..... A63B 69/0057 482/121
6,322,461 B1 * 11/2001 Walsh ..... A63B 63/06 473/422
6,500,078 B1 * 12/2002 Williams ..... A63B 69/0002 473/452
6,663,512 B2 * 12/2003 Martin ..... A63B 24/0021 473/452
6,899,646 B2 * 5/2005 Conradi ..... A63B 69/0002 473/422
6,916,256 B1 * 7/2005 Buster ..... A63B 69/0002 473/422
6,932,712 B2 * 8/2005 Cardosi ..... A63B 69/3641 473/261
6,945,883 B1 * 9/2005 Williams ..... A63B 69/0002 473/422
7,338,395 B1 3/2008 Hurley
7,601,081 B1 * 10/2009 Larkey ..... A63B 69/0002 473/422
7,927,238 B2 * 4/2011 Mejia Perez ..... A63B 69/0002 473/452
8,678,956 B2 * 3/2014 Thomas ..... A63B 69/0002 473/452
8,784,230 B1 * 7/2014 Mitchell ..... A63B 69/0057 473/452
2006/0046864 A1 * 3/2006 Pagano ..... A63B 69/3667 473/270
2006/0068947 A1 * 3/2006 Kempf ..... A63B 69/0002 473/451
2006/0234816 A1 * 10/2006 Reason-Kerkhoff ..... A63B 69/0002 473/452
2011/0021296 A1 * 1/2011 Johnston ..... A63B 69/0002 473/452
2011/0092318 A1 * 4/2011 Torch ..... A63B 69/0002 473/452
2016/0067577 A1 * 3/2016 Howard ..... A63B 69/0002 473/452
2016/0236053 A1 * 8/2016 Frampton ..... A63B 69/0002 473/452

* cited by examiner

UNDERHANDED PITCH TRAINING DEVICE

This application claims the benefit of U.S. Provisional Application No. 62/116,076 filed on Feb. 13, 2015 titled UNDERHANDED PITCH TRAINING SYSTEM.

FIELD OF THE DISCLOSURE

The present disclosure relates generally to an underhanded pitch training device. More so, an underhanded pitch training device that is used to train a softball pitcher the optimal pitching motion for softball pitches by correctly orienting a drive foot and maintaining a stride foot at a predetermined height and length of stride.

BACKGROUND

It is well known that a significant number of our youth participate in the game of softball. At very early ages players start with learning the underhand pitch and progressively move through the ranks of organized leagues during their early teens. It is also a well known fact that good habits are very important to develop and instill in a player's routine. All positions on a baseball team require physical endurance and coordination. However, the position of pitcher requires specialized training above and beyond that which is required of all other positions. Therefore, the earlier a youngster is taught the proper mechanics of pitching, it will become second nature for her to step onto the pitchers rubber and pitch in an effective manner. It has also been found that repetition in practice sessions where the pitcher properly repeats the body positioning and motions required for a pitcher is the key to successful pitching.

It is for the above stated reasons that applicant has designed the subject pitcher's training device to aid in the development of proper pitching mechanics.

SUMMARY OF THE DISCLOSURE

The present disclosure of a pitching training device generally comprises a platform configured to support a pitcher performing an underhanded pitch having a generally T-shaped end with a raised pitchers rubber configured to support the pitcher during delivery of the underhanded pitch, and a pair of removable heel guides to inhibit rotation of a drive foot of the pitcher; a stride section, removably connected to and positioned to extend longitudinally from said generally T-shaped end; said stride section having a goal post assembly configured to movably position a stride bar across said stride section.

A general object of the present disclosure is to provide a pitch training device used to train a pitcher to maintain the lower body in a proper alignment.

Another object of the disclosure is to provide a pitch training device to align the drive foot of the user by the use of heel guides and the elevation and length of the stride foot by the use of an adjustable goal post assembly while performing an underhanded pitch.

Another object of the present disclosure is to provide a pitch training device that is portable and easy to assemble.

Still another object of the present disclosure is to provide a pitch training device which is customizable to the height of the individual user.

Still a further object of the present disclosure is to provide a pitch training device having adjustable goal post assembly to accommodate pitchers of different leg length and strides.

Another object of the disclosure is to provide a T-end having pitching rubber with heel guides that can be used by either a left or right-handed pitcher.

Yet another object of the disclosure is to provide a training device that includes friction surfaces to limit or minimize slippage during use thereof.

A further object of the disclosure is to provide a training device with a landing area positioned and dimensioned to train the user in consistently achieving an extension of a stride foot during delivery of a pitch.

These and other objects, features and advantages of the present disclosure will become readily apparent to those having ordinary skill in the art upon a reading of the following detailed description in view of the appended claims and drawings.

BRIEF DESCRIPTION OF THE DRAWINGS

The disclosure will now be described, by way of example, with reference to the accompanying drawings, in which:

FIG. 1A illustrates a front view, and FIG. 1B illustrates a rear view, in accordance with an embodiment of the present disclosure;

Like reference numerals refer to like parts throughout the various views of the drawings.

DETAILED DESCRIPTION OF THE DISCLOSURE

Figure 1A:
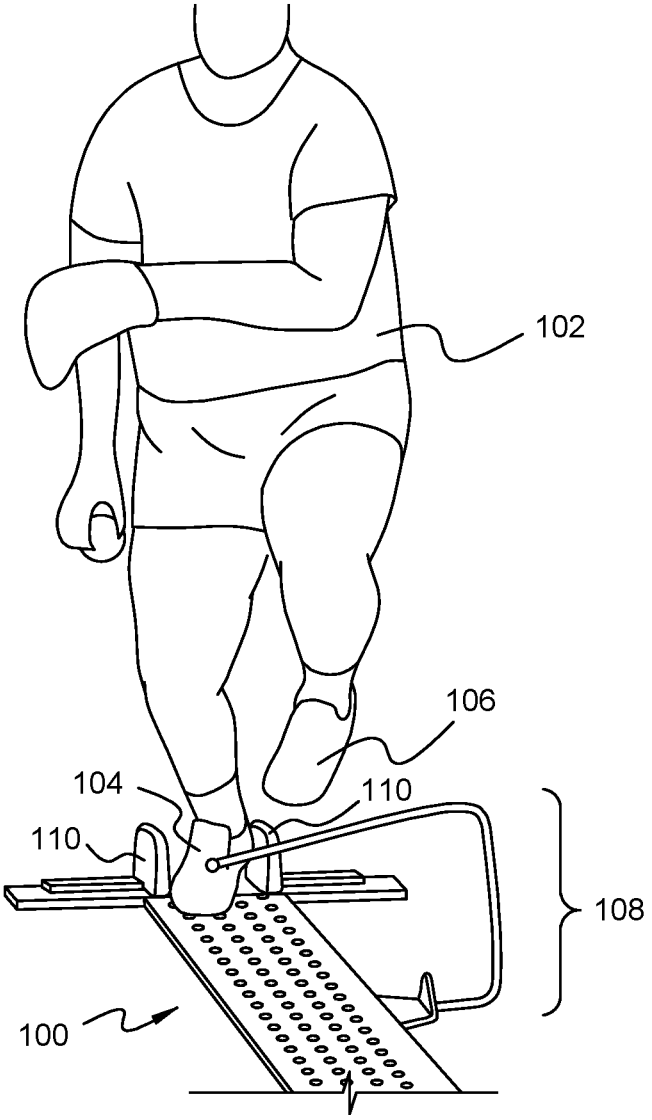
FIGS. 1A and 1B illustrate detailed perspective views of an exemplary pitcher performing an underhanded pitch, where

At the outset, it should be clearly understood that like reference numerals are intended to identify the same structural elements, portions, or surfaces consistently throughout the several drawing figures, as may be further described or explained by the entire written specification of which this detailed description is an integral part.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the disclosure as oriented in FIG. 1A.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

This disclosure generally relates to a pitching training device generally having a platform with a generally T-shaped end and a raised pitchers rubber configured to support the pitcher during delivery of the underhanded pitch, and a pair of removable heel guides to inhibit rotation of a drive foot of the pitcher. A stride section, removably connected to and positioned to extend longitudinally from said generally T-shaped end. A goal post assembly configured to movably position a stride bar across the stride section. The stride bar is positioned as a target for a drive foot of the pitcher to clear a predetermined height during the underhanded pitch. The device is lightweight and portable, useable indoors or on a practice field and is operable for left or right handed pitching.

FIGS. 1A to 9 illustrate an underhanded pitch training device 100 used to train a pitcher 102 to maintain the lower body in a proper alignment and elevation while performing an underhanded pitch. The device 100 is configured to force the feet and legs of a softball pitcher 102 into an optimal direction and movement for underhand pitches. Specifically, the device 100 helps keep a softball pitchers 102 stride in a generally aligned straight line by limiting rotational movement of a heel of a drive foot 104 at the beginning of the pitch, and by forcing a stride foot 106 above a predetermined height during the underhanded pitch. The proper positioning and movement of the drive foot 104 and stride foot 106 affect the other components of the underhanded pitch, such as the upper body torque and the arm wind up. This is because the lower body is the genesis for power during the underhanded pitch and the feet of the pitcher dictate the lower body movements. In some embodiments, the device 100 is lightweight and portable, useable indoors or on a practice field. The device 100 can be used by either left or right-handed pitchers 102.

Figure 1B:
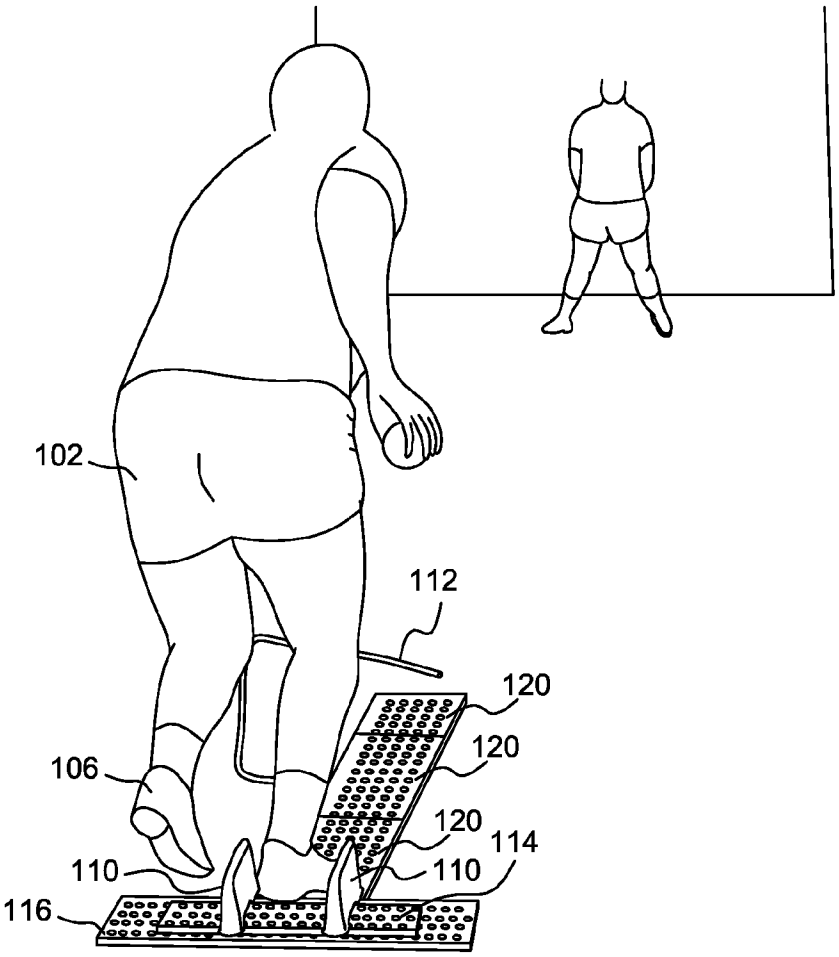

FIGS. 1A and 1B illustrate an exemplary underhanded pitch and the proper positioning of a drive foot 104 and a stride foot 106 during the underhanded pitch. Those skilled in the art will recognize that performing underhanded pitching requires proper body mechanics in order to develop optimum pitch velocity, controlled placement, and the intended spin on the ball. Initially, the pitcher 102 assumes a stance on a pitching rubber that is comfortable, standing tall, with the shoulders back, and the feet far enough apart for maintaining balance. The pitching rubber is often on an elevated mound. As referenced in FIG. 1A, the device 100 replicates the pitching mound for training purposes.

Typically, a drive foot 104 (on the throwing arm side) is used to push off the mound (FIG. 1A). The drive foot 104 is positioned at the front of the pitching rubber. At least half of the drive foot 104 must be on the surface of the pitching rubber prior to the pitch. The drive foot 104 pushes off against the front edge of the pitching rubber; thereby starting the drive outward, the long stride, and the resulting speed of the pitch. A heel on the drive foot 104 must orient in a substantially straight forward direction during the pitch to keep the rest of the body aligned forward. Excessive rotation of the drive foot 104 can create misalignment for other parts of the body, which reduces the power on delivery of the pitch. A stride foot 106 (on the glove side) positions behind the pitching rubber. The step that is taken with stride foot 106 is the stride, and is performed as an upward leap followed by a long forward stride (FIG. 1B). A typical stride for a leaping-style pitcher is 90% to 120% of the pitcher's height. During the pitch, the stride foot 106 should clear vault/leap a specific height during the pitch to optimize power of the underhanded pitch.

As further depicted in FIG. 1A, during the stride, approximately halfway through arm rotation, the pitcher 102 is in an open position, or totally sideways to the catcher. As the arm comes down in the final swing toward the release, the upper body, and then the hips start to close. However, the hips should only be approximately halfway closed at the precise release point of the ball. Then, after the release, the hips continue to close, allowing the pitcher 102 to finish in the ready position facing the batter. The open and closed position of the hips and arms are greatly dictated by the positioning of the drive foot 104 and the stride foot 106. The present disclosure helps train the drive foot 104 to maintain a straight alignment, and the stride foot 106 to remain above a predetermined height while performing the underhanded pitching motion.

Figure 2A:
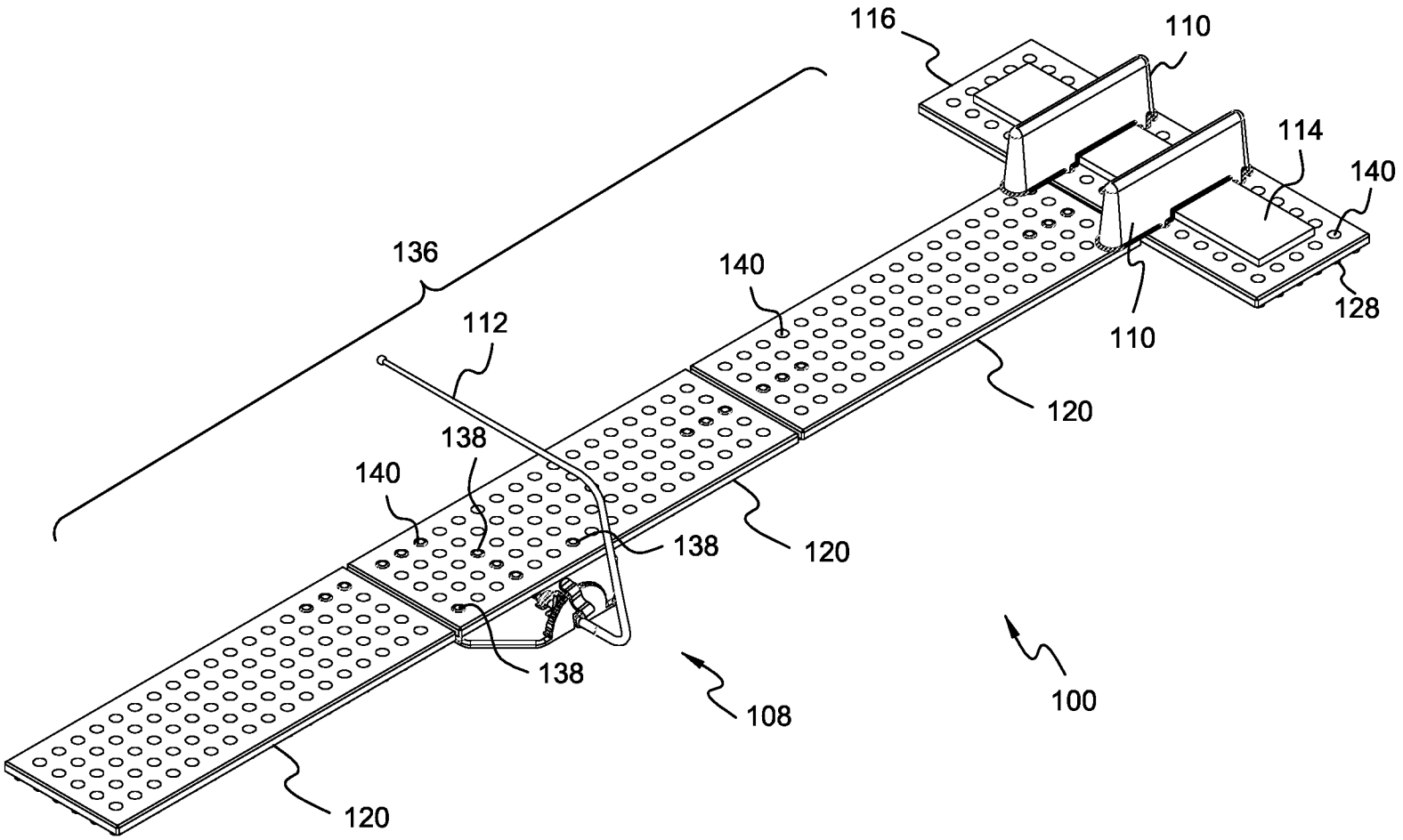
FIG. 2A illustrates perspective view of an exemplary underhanded pitch training device, in accordance with an embodiment of the present disclosure.

Turning now to FIG. 2A, the device 100 comprises a platform 136 having separate base sections, including, a T-end section 116, and at least 3 identical stride sections 120, perpendicular, centered and extended from the T-end 116. Platform 136 is configured to support the weight of a softball pitcher 102 while performing a pitch. The removable components (detachable heel guides 110 and goal post assembly 108) are adjustable so as to allow different sized pitchers to maintain proper placement throughout a pitch. The platform 136 can be used on a flat, smooth ground or floor surface. The pitcher 102 can practice the underhanded pitch while partially standing on a combination of the T-end 116, the pitching rubber 114 and the closest joined stride section 120. In essence, the device supplants the pitcher's mound for training purposes. The aforementioned components and positions of the device 100, help orient the drive foot 104 and train for proper lift on the stride foot 106 to train for an optimal underhanded pitching motion.

Figure 2B:
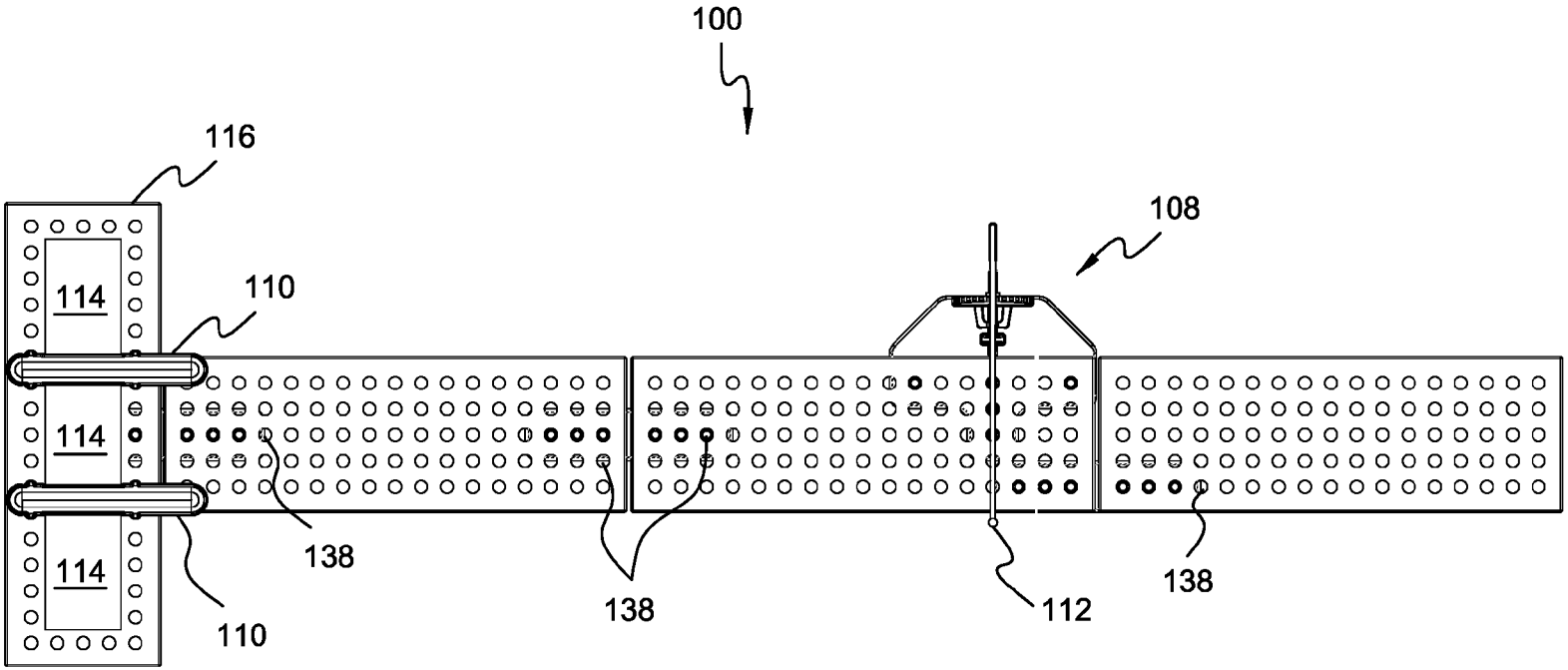
FIG. 2B illustrates a top view of an exemplary underhanded pitch training device, in accordance with an embodiment of the present disclosure.

FIG. 2B illustrates a top view of an exemplary underhanded pitch training device, in accordance with an embodiment of the present disclosure. In some embodiments, the platform 136 may be comprised of a material sufficiently light enough to enable portability and minimal labor for assembly. In one embodiment, the fully assembled platform 136 is about 8' long and 9" wide. The platform 136 may also be about 1" thick, however other dimensions may be possible. Suitable materials for the platform 136 may include, without limitation, polymers, wood, rubber, composite recycled materials, aluminum, petroleum based and any combinations thereof and the like.

Figure 3:
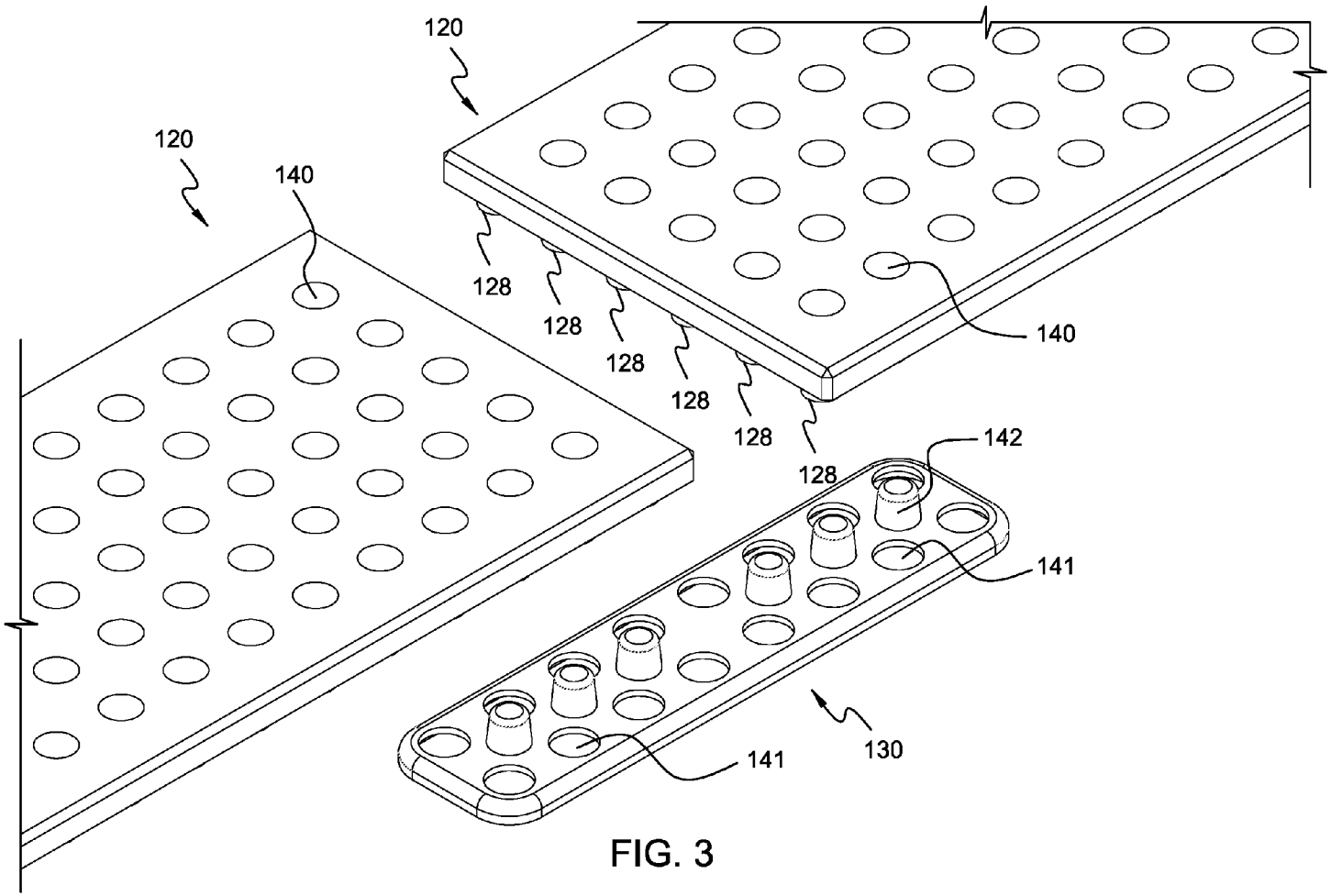
FIG. 3 illustrates an exploded sectional perspective view of an exemplary platform with a joinder attachment means in accordance with an embodiment of the present disclosure.

Those skilled in the art will recognize that softball mounds are generally flat, so the device is best utilized indoors, on smooth surfaces, such as an indoor gym having a wood, a tile, and/or concrete floors. The underside of the platform 136 may be comprised of a series of pre-molded, rounded protrusions called nubs 128, to provide the necessary "give" (resilience) as well as elevation of the platform, as shown in FIG. 3. The entirety of the platform 136 is comprised of recycled crumb rubber and miscellaneous polymer/resin materials that create a non-slip bottom surface. The texture of the top of the stride sections are configured of sufficient anti-slip material in order to inhibit undesirable sliding of the stride foot 106 upon returning to the platform 136 and provides the drive foot 104 sufficient traction to generate power during the underhanded pitch.

The platform 136 includes a T-end 116, where the training of proper feet position occurs. T-end 116 is approximately 32" in length and provides a surface for the pitching rubber 114 and detachable heel guides 110 so as to position the drive foot 104. The detachable heel guides 110 accommodate a left or right handed pitcher 102. In some embodiments, the T-end 116 of the device can be used with or without the pair of heel guides 110 that extend vertically from the sides. The heel guides 110 can be constructed to form a barrier that inhibits the heel of the drive foot 104 from pivoting during the underhanded pitch. This limited movement of the drive foot 104 is what maintains the straight alignment for the lower and upper body.

The platform 136 further comprises a stride section 120 that forms a continuous extension from the T-end 116. The stride section 120 consists of 3 identical sections, which are detachable and fasten to the T-end 116 through a connector 130 (shown in FIG. 3). In one embodiment, the stride section 120 is comprised of multiple sections of about 32" in length which combine to comprise a total extension of about 81" from the T-end 116. Stride section 120 includes a height adjustable, goal post assembly 108, that has a stride bar 112 which extends both vertically and laterally. Stride bar 112 has a flexible rod whip portion 115 (shown in FIG. 5) that extends across stride section 120. The stride bar 112 is elevated such that the stride foot 106 is forced to leap above a predetermined height during the underhanded pitch. In some embodiments, the entirety of goal post assembly 108 is adjustably positioned along any section of the stride section 120, thereby allowing the user to vary the length of the stride during training of a pitcher.

In operation, the device 100 supports and orients the stride foot and the drive foot in positions prior to the underhanded pitch, and train the movement of the stride foot 106 during the underhanded pitch. The stride foot 106 can step on the side of the T-end 116 prior to the pitch, or can remain just off of the edge, depending on the users' personal comfort level. The drive foot 104 remains about shoulder width apart from the stride foot 106 before pushing off the T-end 116 to commence the pitch. The drive foot 104 pushes off against the forward edge of the ½" thick, raised pitchers' rubber 114, which is centered and fixed on the T-end 116. A heel on the drive foot 104 must orient in a substantially straight forward direction during the pitch to keep the rest of the body aligned forward. Excessive rotation of the drive foot 104 can create misalignment for other parts of the body, which reduces the power on delivery of the pitch. The stride foot 106 performs an upward leap, followed by a long forward stride. During the pitch, stride foot 106 should clear a specific height during the pitch to optimize power of the underhanded pitch. Stride foot 106 vaults over the horizontal stride bar 112 and lands in front of the goal post assembly 108. It is significant to note that the goal post assembly 108 should be offset approximately 6" from the side of the platform 136. Stride bar 112 is set in a position to create an obstruction. If the leaping action of the stride foot is not high enough, nor on a path to intersect it with the longitudinal axis of the platform, the stride foot will not clear the stride bar.

Figure 2C:
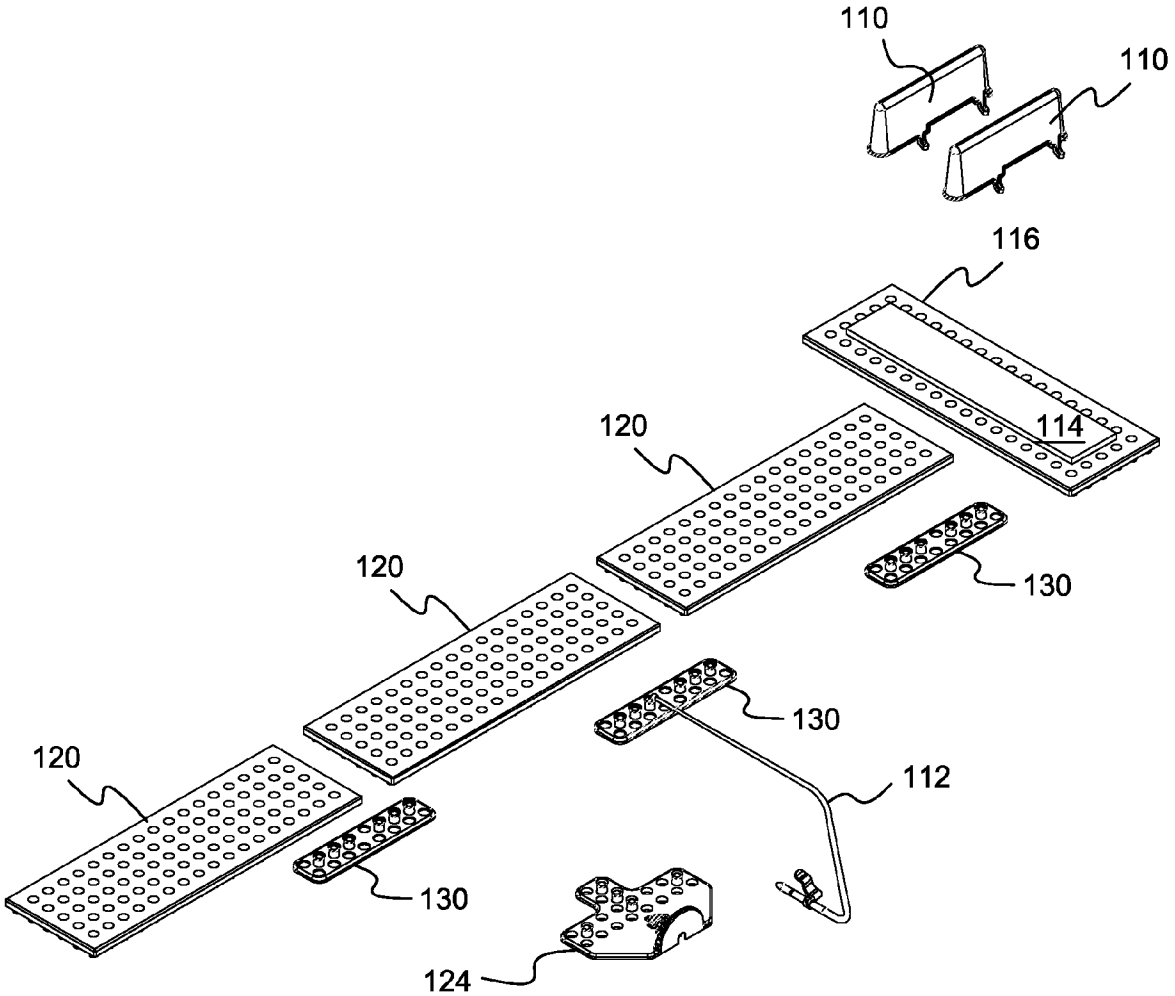
FIG. 2C illustrates an exploded perspective of an exemplary underhanded pitch training device, in accordance with an embodiment of the present disclosure.

FIG. 2C illustrates an exploded perspective of an exemplary underhanded pitch training device, in accordance with an embodiment of the present disclosure. In a preferred embodiment, the platform 136 will include at least three (3) sections 120 that detachably join to each other and to the T-end section 116 through a connector 130.

FIG. 3 illustrates an exploded sectional perspective view of an exemplary stride section with a joinder attachment means in accordance with an embodiment of the present disclosure. Joinder attachment means are the "connectors" that are manufactured from an approximately ⅜" thick plastic/polymer sheet. The stride section 120 consists of 3 identical sections, which are detachable and fasten to each other and to the T-end 116 through a connector 130. The bottom surface of platform 136 has a plurality of inserting nubs 128 to be inserted in a mating plurality of 'thru holes' or connector holes 141 in connector 130. Connector 130 also has a single row of raised nubs 142, which mate securely in the matching thru holes in the bottom side of the platform. Nubs 128 extend along the underside of the entire platform 136 to provide elevation for platform 136 and separation from the ground surface as shown in FIG. 3. Nubs 128 may consist of a uniformly shaped and spaced series of circular/spherical terminals. Those skilled in the art will recognize that the platform 136 must remain stable while the pitch is executed. Additionally, the weight of the pitcher 102 helps stabilize the platform 136.

The preferred size of a stride section is approximately 9"×27" with ¾" diameter nubs that form a symmetrical pattern to mate with the "connectors" that attach the sections together. This "hole and nub" pattern easily allows for easy assembly/disassembly of the platform 136, as well as securing the goal post assembly 108. Inserting holes 140 for the platform are just barely offset from the nubs on the bottoms of the sections of the platform. The holes remove unnecessary weight/cost, while not compromising structural aspects of each section. In addition, the holes act in conjunction with the nubs to increase the shock absorption factor of the material, thereby diminishing the wear and tear on the pitcher.

In some embodiments, sections 120 and T-end 116 mate through grooved slots, finger joints, or other type of fastening mechanisms suitable for lightweight portable pitching platforms. Those skilled in the art will recognize that the capacity of the platform 136 to break into sections, enables portability. The portability of the device 100 may be useful for enabling training of the underhanded pitch to be performed indoors during all types of inclement weather.

Figure 4:
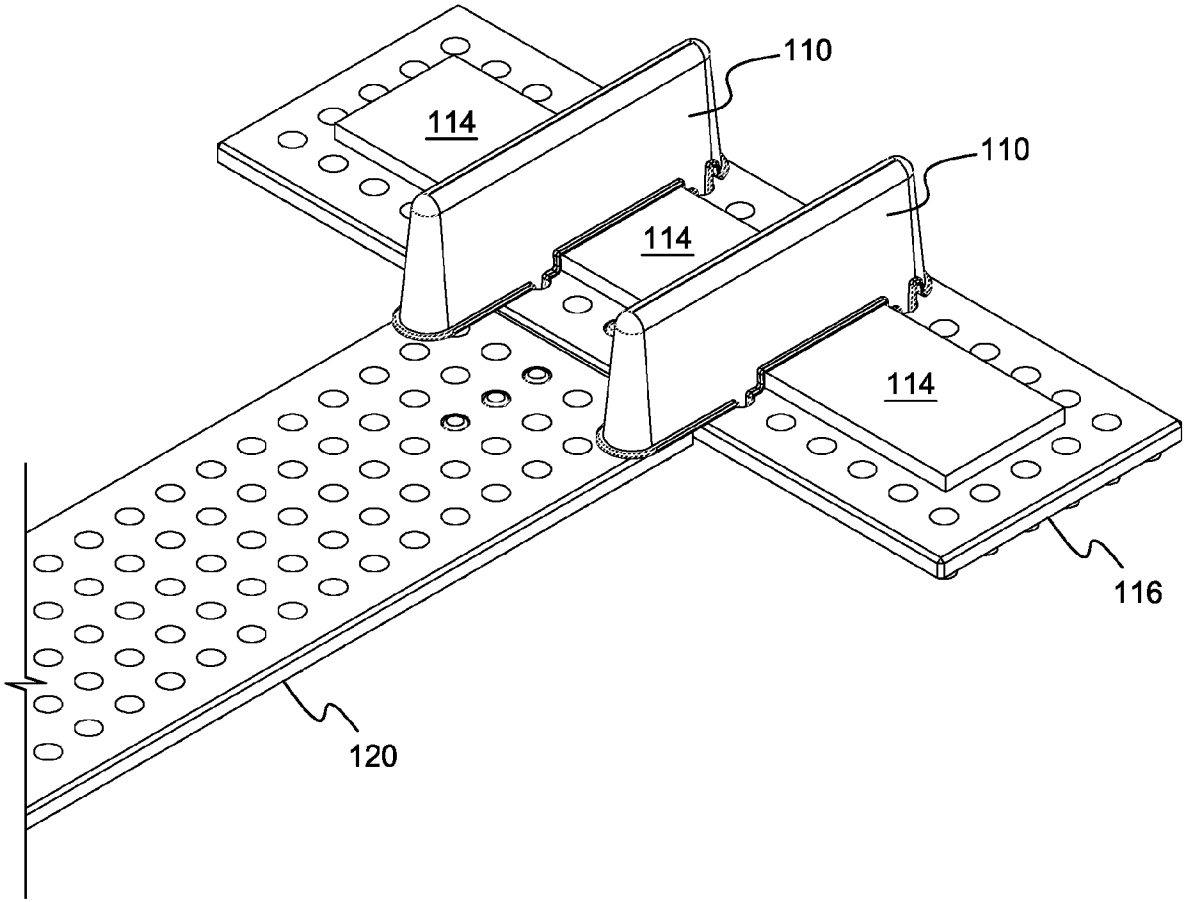
FIG. 4 illustrates a detailed perspective view of an exemplary platform T-end with an exemplary pair of heel guides in accordance with an embodiment of the present disclosure.

As shown in FIG. 4, the platform 136 includes the T-end 116 where pitcher 102 stands to begin a pitch. The surface of T-end 116, the rubber and the stride section also provides traction for the drive foot 104. T-end 116 utilizes a pair of rigid, yet flexible heel guides 110 on each lateral edge. The heel guides 110 are rigid enough to keep drive foot 104 between the heel guides in a forward orientation, yet have sufficient flexibility to enable slight movement when engaged with the heel of the drive foot 104. In this manner, the pair of heel guides 110 force the rear heel of the drive foot 104 to point forward, generally along a longitudinal axis of the platform 136. T-end 116 further includes a raised, molded and securely attached pitchers' rubber 114, approximately ½" in height and 4"×21" long. Those skilled in the art will recognize this pitchers' rubber as an integral component of all outdoor softball playing fields. T-end 116, provides a surface for the stride foot 106 outside of the heel guides to rest upon until the pitch commences.

Figure 5:
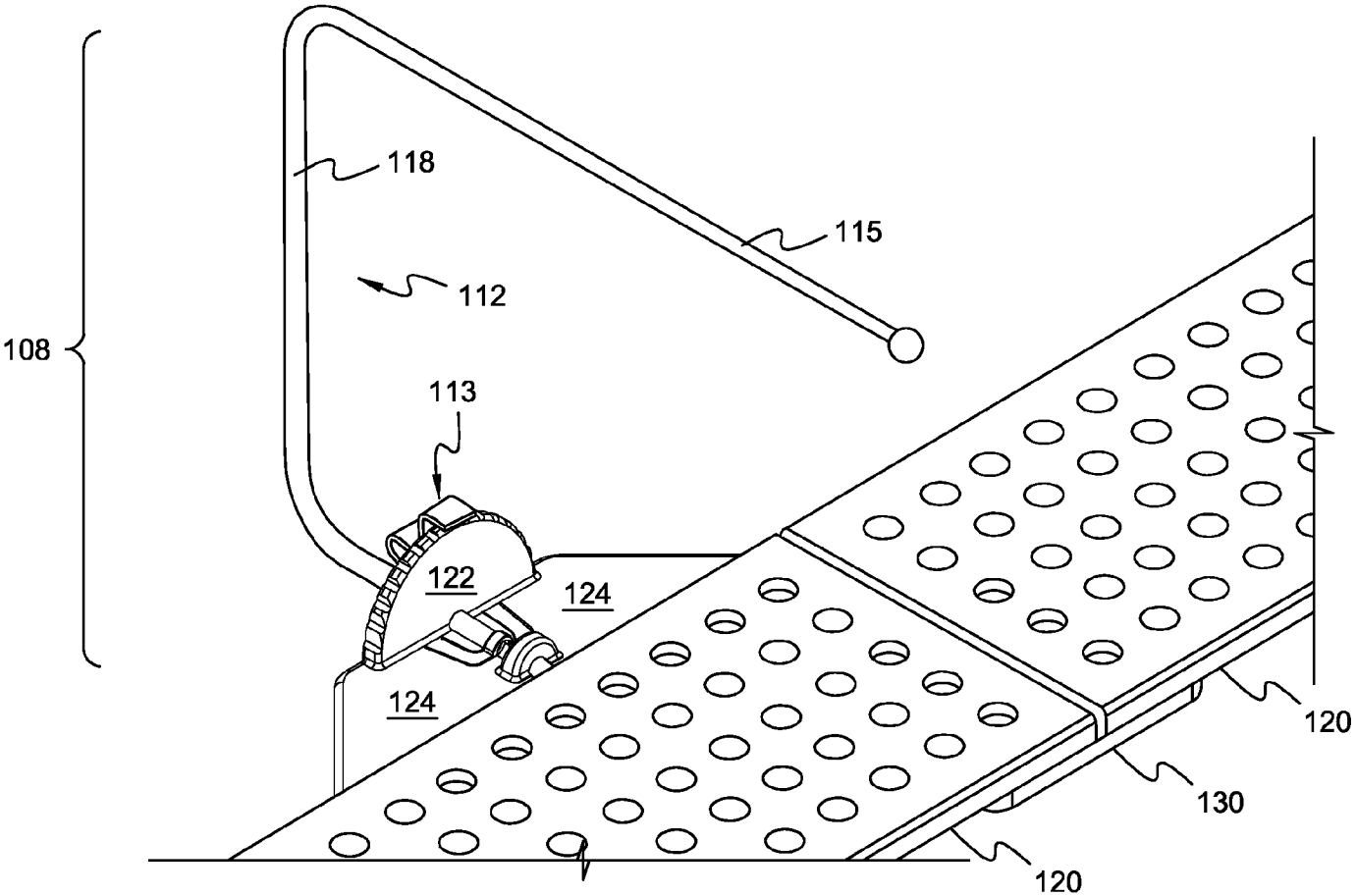
FIG. 5 illustrates a detailed perspective view of an exemplary goal post assembly joined with the platform, in accordance with an embodiment of the present disclosure.

FIG. 5 shows a functional goal post assembly 108, having mounting bracket 124 mounted to stride section 120. Stride bar 112 is configured to be inserted through slot 121 (shown in FIG. 7B) in the mounting bracket and a semi-circular toothed disc 122. The stride bar 112 is held in position by fastening clip 113 and a yoke 123 which is a fixed collar that insertably and rotatably receives the stride bar. (shown FIG. 7A).

In some embodiments, the stride bar 112 is generally J-shaped, and extends upwardly/vertically from the stride section 120, approximately 3'-4' from the T-end 116. The stride bar 112 may be comprised of without limitation, a string, a rope, a bar, a cord, or tube. In a preferred embodiment, the stride bar 112 can be adjustable to heights of about 1"-10." In sum, stride bar 112 is adjustable to rotate and move to variable heights and lengths, thus forcing the pitcher to lift the stride foot 106 at a predetermined height, and land at a predetermined position that is necessary for a proper underhanded pitch and thereby optimize the pitching motion.

Those skilled in the art will recognize that different softball leagues have different pitching rules. Also, the users of the present disclosure may vary in age and size. Therefore, the stride bar 112 is adjustable for height and lateral movement to compensate for variously sized pitchers 102 and pitching strides. The mounting bracket 124 is operatively constructed to allow the entire goal post assembly to removably inserted, so as to be optionally positioned at different points longitudinally along the platform.

The goal post assembly consists of a polymer material, which in conjunction with the serrations and grooves of the semi circular toothed disc and the fastening clip 113, allow the entire goal post assembly 108 to withstand an inadvertent impact by the users' foot. The stride bar 112 is constructed to be pliable and flexible enough to bend and give way and to spring back into position when the horizontal whip portion 115 of the stride bar is struck by either foot of the pitcher. Conversely, the serrations and grooves have sufficient flexibility to allow the stride bar 112 to rotate forward and downward when the vertical portion 118 of the stride bar 112 is struck. When a user inadvertently stumbles and falls, kicks, trips or otherwise impacts vertical portion 118 of stride bar 112, fastening clip 113 releases from the teeth in the toothed disc and the bar moves without breaking.

The intent of the design characteristics of the goal post assembly 108 is to mitigate the inadvertent striking of the assembly by either foot, or any part of the body. Stress points may result in various locations within the overall goal post assembly 108 from the stride foot 106 repetitively striking the horizontal or the vertical portions of stride bar 112. The ability to rotate stride bar 112, combined with flexibility of the material of which the entirety of the goal post assembly is comprised, will mitigate these stress points. Selection of resilient flexible materials will allow bending or flexing of the members, as well as rotational movements, in order to preclude tripping of the user and breakage of the component parts.

Figure 6:
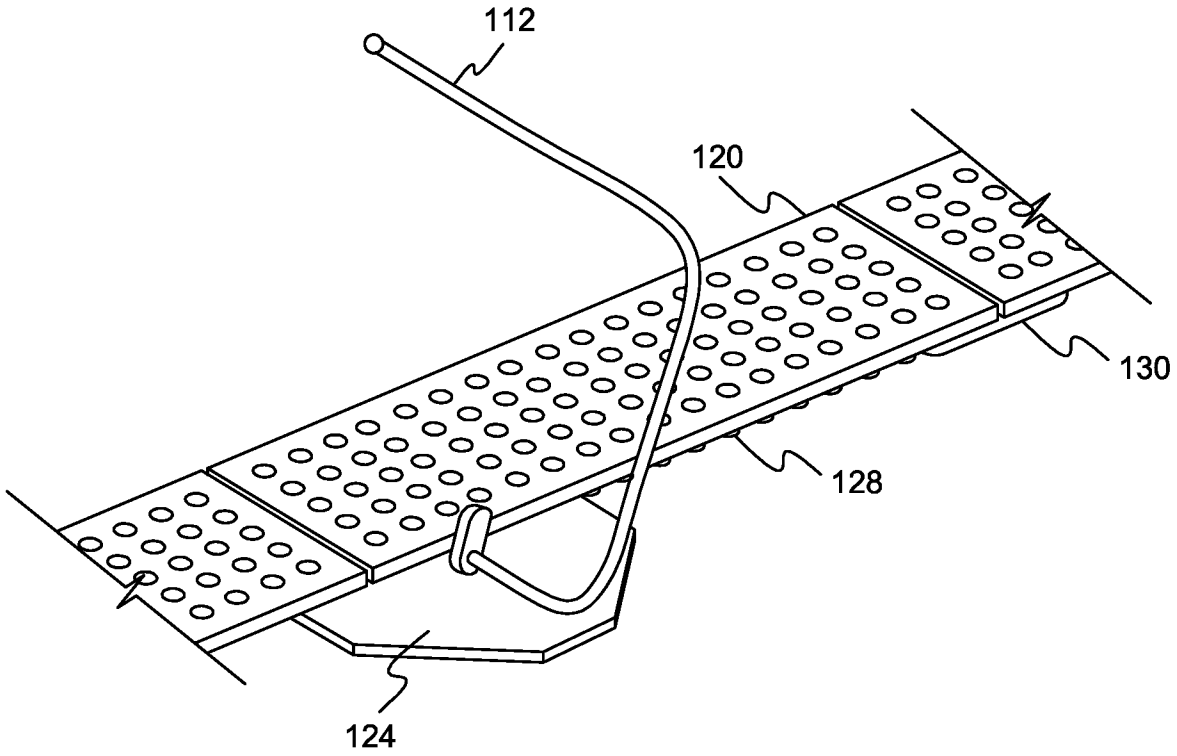
FIG. 6 illustrates a detailed perspective view of an exemplary goal post assembly of an underhanded pitch training device, in accordance with another embodiment of the present disclosure.

FIG. 6 illustrates a detailed perspective view of an exemplary underhanded pitch training device, in accordance with another embodiment of the present disclosure. In this embodiment there is no semi-circular toothed disc 122. Stride bar 112 here has a rotational axle inserted to mounting bracket 124 so that the height of the stride bar 112 is adjusted when the stride bar/goal post is rotated about an axis. This forward rotational movement operates to lower and/or raise the stride bar 112 to adjustably elevate back to a position about 10" high and which is perpendicular to the stride section 120. The stride bar in all of the embodiments is configured to bend, flex, clutch and spring back.

Figure 7A:
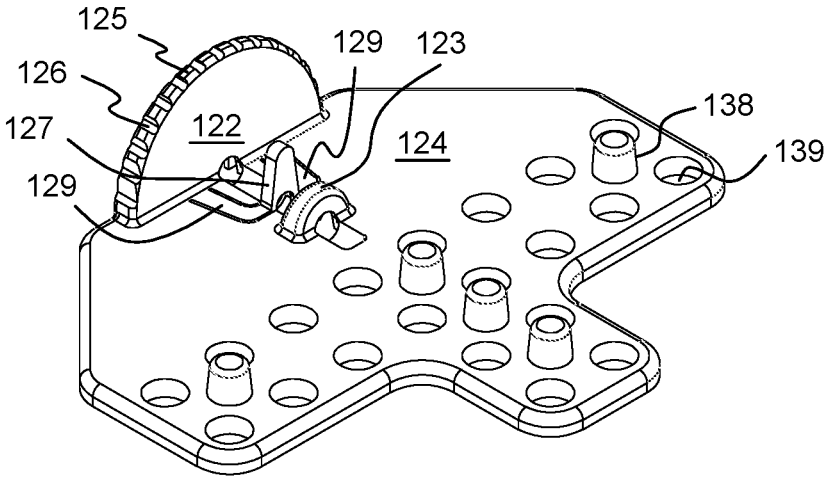
FIG. 7A illustrates a front perspective view of an exemplary mounting assembly, without the detachable interlocking component in accordance with an embodiment of the present disclosure.

FIG. 7A illustrates a front perspective view of an exemplary mounting bracket 124 in accordance with an embodiment of the present disclosure. The mounting bracket in this illustration shows the common flat base with the ¾" diameter symmetrical openings called holes 139 and nubs 138, which are the exact reverse pattern as in the inserting holes 140 and nubs 128 in stride sections 120. This configuration allows the nubs 138 and holes 139 on the mounting bracket, to mate with the stride section inserting holes 140, and nubs 128, to maintain position during use and be removable to position and adjust to the preference of different sized users. It is important for the user to stay focused on pitching and without having the need to continually re-position the training aid.

Figure 7B:
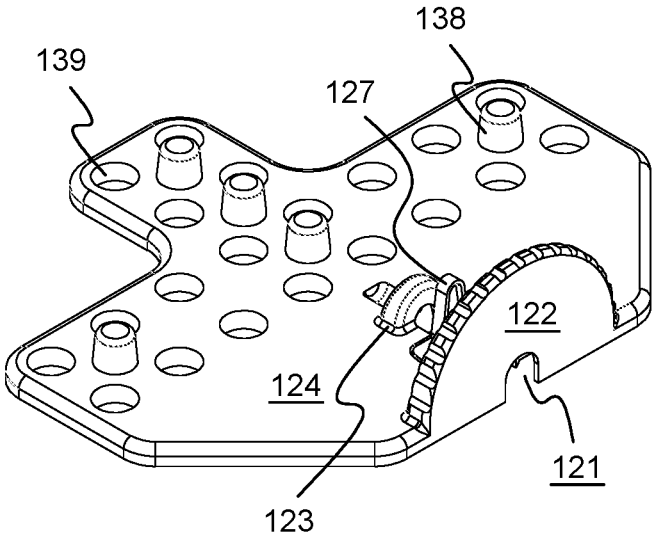
FIG. 7B illustrates a back perspective view of an exemplary mounting assembly, without the detachable interlocking component in accordance with an embodiment of the present disclosure.

FIG. 7B illustrates a back perspective view of an exemplary mounting bracket in accordance with an embodiment of the present disclosure. The cylindrical shape of stride bar 112 allows it to be inserted through slot 121 and rotatably held by spring latch 127 and yoke 123 which are fixedly attached to the mounting bracket 124.

Figure 7C:
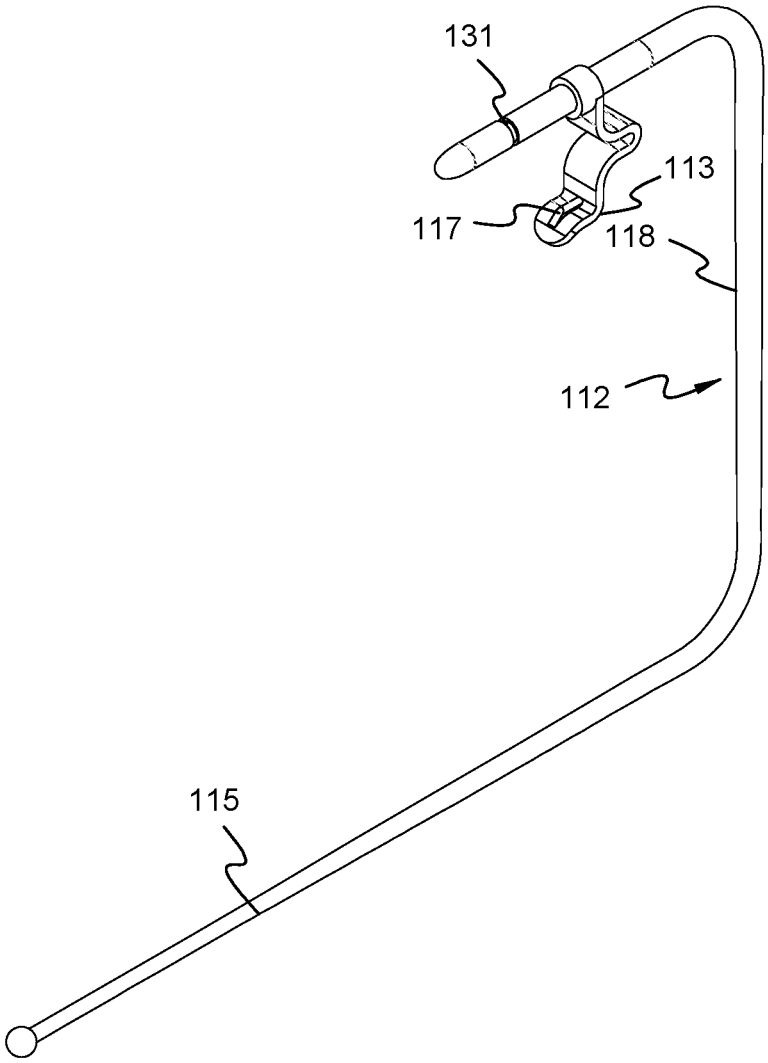
FIG. 7C illustrates a side view of a stride bar in accordance with an embodiment of the present disclosure.
Figure 7E:
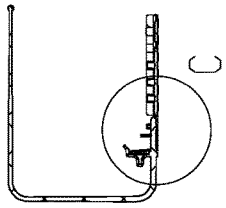
FIG. 7E illustrates cross sectional view a side view of the present disclosure.
Figure 7D:
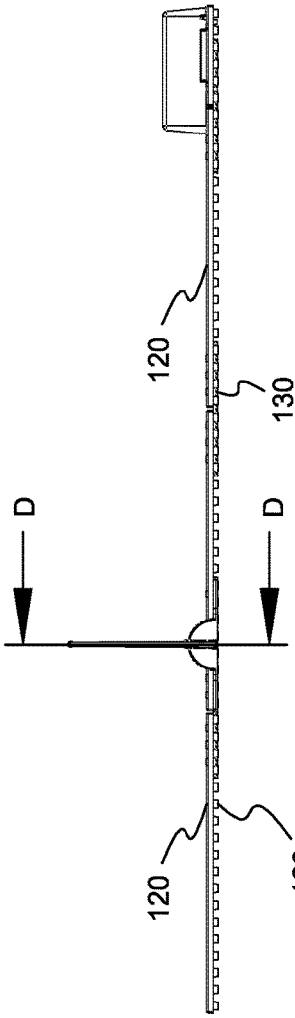
FIG. 7D illustrates a side view of the present disclosure.

FIG. 7C illustrates a side view of stride bar 112 which is generally configured in a "J" shape. Fastening clip 113 is mounted to stride bar 112. Fastening clip has a keeper 117 which is a tongue that is constructed to operatively engage with semi-circular toothed disc 122. FIG. 7D illustrates a side view of the present disclosure. FIG. 7E illustrates cross sectional view a side view of the present disclosure.

Figure 7F:
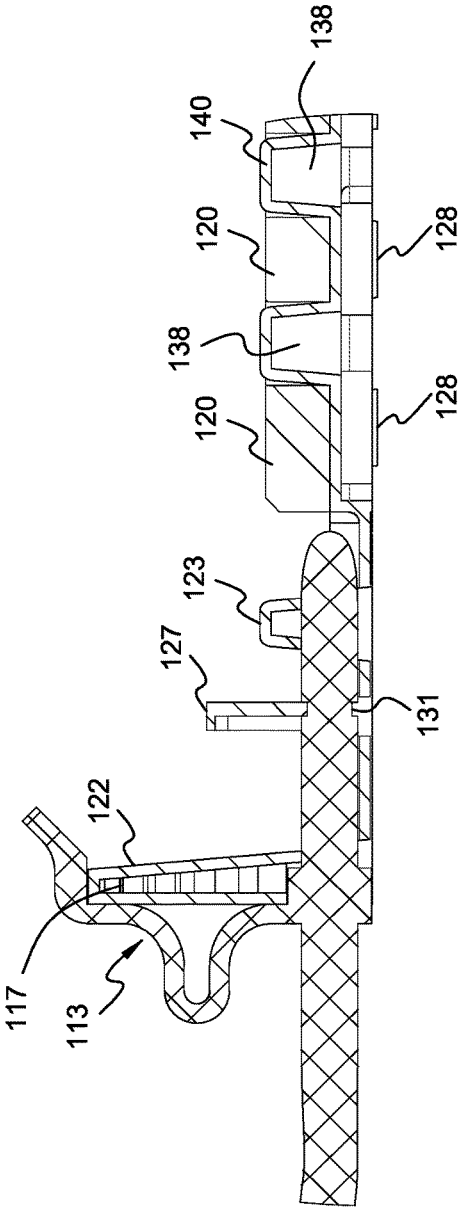
FIG. 7F is a detailed cross sectional view of the present disclosure, taken generally along line D-D in FIG. 7D.

FIG. 7F is a detailed cross sectional view of the present disclosure, taken generally along line D-D in FIG. 7D. Stride bar 112 is inserted through slot 121 (as shown in FIG. 7B) in the vertical face of the semi-circular toothed disc 122 at the base of mounting bracket 124. Stride bar 112 is fully seated in the mounting bracket 124, with fastening clip 113 hooked over the top of the semi-circular toothed disc 122. Keeper 117 clips into the female serrations 126 between teeth 125 (shown FIG. 7A) in the semi-circular toothed disc. Stride bar 112 is inserted through slot 121 and rotatably held by spring latch 127 and yoke 123 which is fixedly attached to the mounting bracket 124. Spring latch 127 is attached to mounting bracket by spring arms 129 (shown FIG. 7A) and is configured to removably mate with notch 131 in stride bar 112. As shown, the spring latch 127 is in a closed position such that notch 131 is pressed against the spring latch. When removing stride bar 112 from the assembly, for example, the user will engage the latch to overcome the spring bias and force of the spring arms to an open position, thus releasing the stride bar. This spring latch enables removal and replacement of the stride bar, if desired, without complete separation of the mounting bracket 124 from the platform.

Figure 8A:
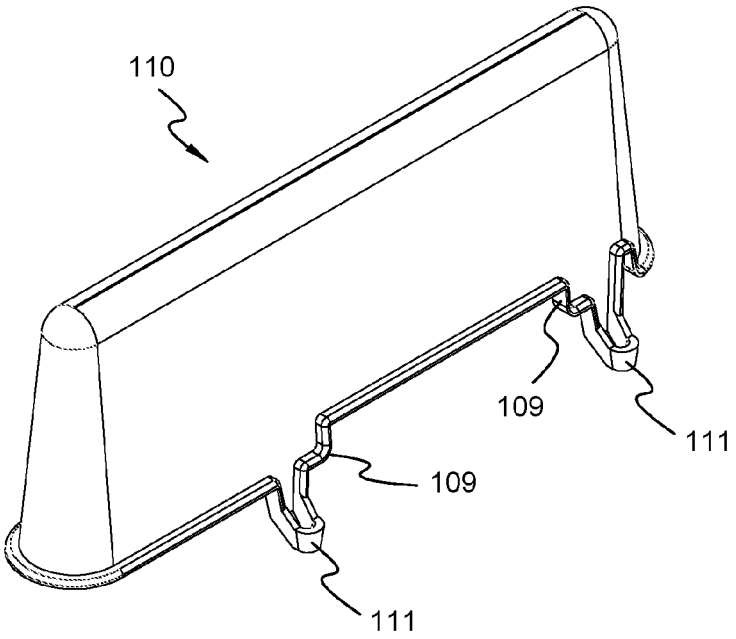
FIG. 8A illustrates a top perspective view of an exemplary heel guide in accordance with another embodiment of the present disclosure.
Figure 8B:
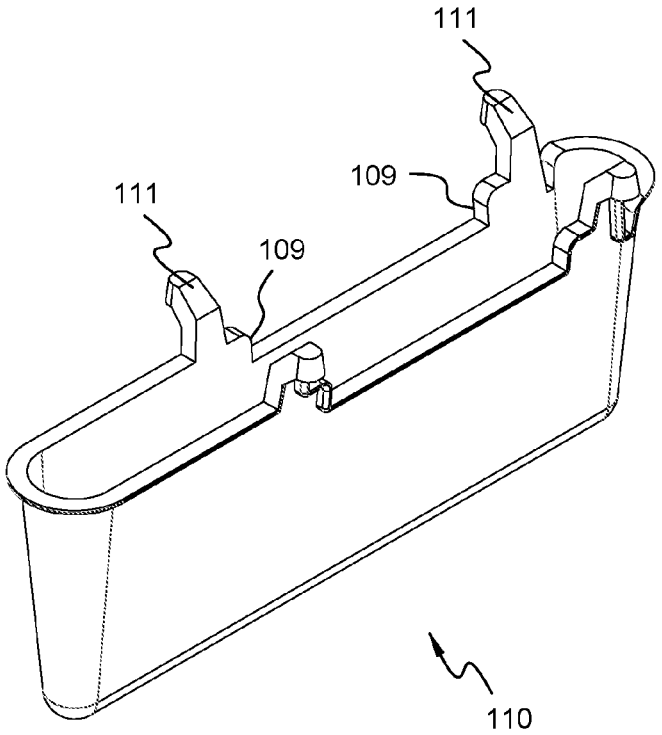
FIG. 8B illustrates a bottom perspective view of an exemplary heel guide in accordance with another embodiment of the present disclosure.

FIGS. 8A and 8B illustrate detailed top and bottom perspective views of the exemplary heel guide sections in accordance with the present disclosure. The device 100 uses a pair of rigid, yet flexible heel guides 110 on each lateral edge. The heel guides 110 are rigid enough to keep drive foot 104 between the heel guides in a forward orientation, yet have sufficient flexibility to enable slight movement when engaged with the heel of the drive foot 104. It should be understood that heel guides 110, when inserted into the platform comprise the heel guide (2 halves make a full exemplary heel guide). FIG. 8B is a bottom perspective view to show hooks 111, a connecting means that removably insert and lock into inserting holes 140. Ledge 109 are indentations at the bottom of each heel guide conformed to mate with an approximately ½" tall pitching rubber positioned on the platform underneath the heel guides.

Figure 9A:
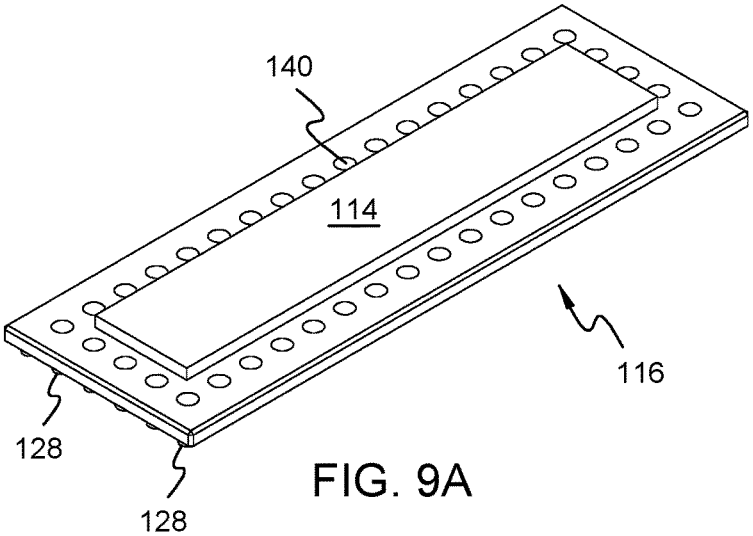
FIG. 9A illustrates detailed top perspective view of an exemplary T-end section means in accordance with an embodiment of the present disclosure.
Figure 9B:
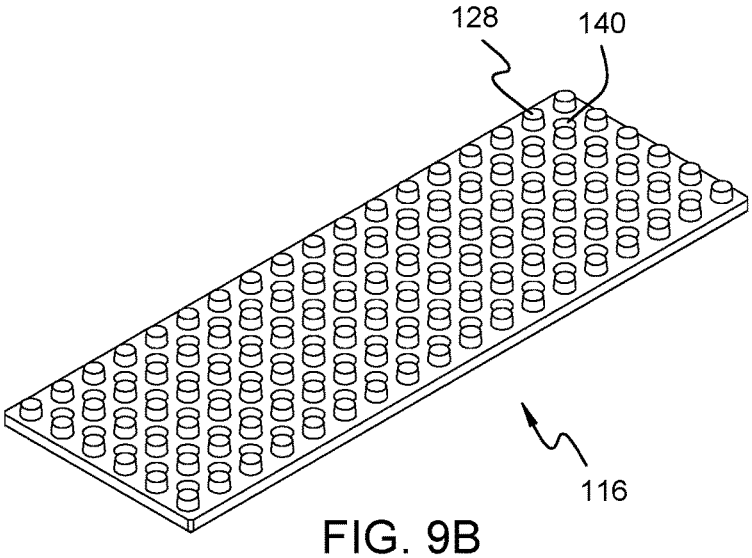
FIG. 9B illustrates detailed bottom perspective view of an exemplary T-end section means in accordance with an embodiment of the present disclosure.
Figure 9C:
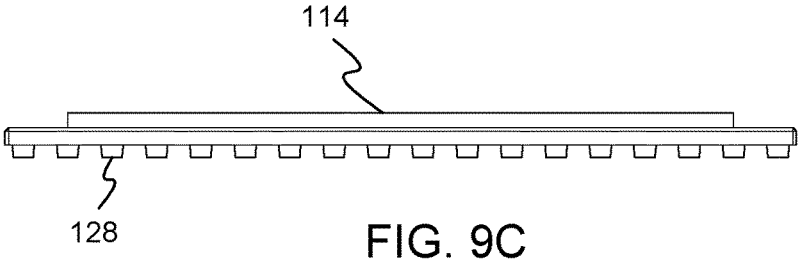
FIG. 9C illustrates a side view of an exemplary T-end section means in accordance with an embodiment of the present disclosure.

FIGS. 9A and B illustrate detailed perspective views of exemplary T-end sections. FIG. 9B illustrates an exemplary bottom perspective view, showing the plurality of inserting holes 140 and nubs 128. This configuration is the same as stride sections 120, in accordance with an embodiment of the present disclosure. FIG. 9A illustrates detailed top perspective view of an exemplary T-end with an attached pitching rubber 114, which is a ½" pitchers' plate/rubber which has a solid top, which is molded directly onto the T-end section. The rubber is preferably molded onto the T-end section but can be connected by mounting screws, rubber bolts or plugs. The T-end section has bottom thru-holes that mate with raised nubs 142 of connector 130 to allow for removably connecting T-end 116 to stride section 120.

Since many modifications, variations, and changes in detail can be made to the described preferred embodiments of the disclosure, it is intended that all matters in the foregoing description and shown in the accompanying drawings be interpreted as illustrative and not in a limiting sense. Thus, the scope of the disclosure should be determined by the appended claims and their legal equivalence. The device could be used for other athletic training without heel guides 110 nor the goal post assembly 108, as for example the baseball pitching motion is significantly different than the softball motion. Those skilled in the art will recognize the benefit of using the device 100, for instructing athletes on a flat, smooth surface having shock absorption ability. Various embodiments can be realized by re-arranging various amounts of the stride sections 120 and coupling them together with the connectors 130. One such embodiment would be to connect an additional stride section behind the T-end 116, in an effort to give bigger/older pitchers additional space and comfort for stride foot 106 that is on the same elevation as the push foot. Other uses are, but are not limited to, catchers' pads, 1$^{st}$ baseman pads, outfielders' pads, on-deck batting circles and even non-slip matting in showers at campgrounds.

Baseball pitchers may seek to train with a platform and coupling components without a goal post assembly 108 and heel guides 110. An embodiment of a baseball configuration would be comprised of a T-end 116 joined to 2 rows of 3 stride sections, thereby making a 'double wide' stride section that is about 18"×81". A plurality of connectors 130 would be used as needed to securely fasten the platform together.

While the disclosure has been illustrated and described in detail in the drawings and foregoing description, the same is to be considered as illustrative and not restrictive in character, it being understood that only the preferred embodiments have been shown and described and that all changes and modifications that come within the spirit of the disclosure are desired to be protected.

What I claim is:

1. A pitch training device comprising:

a platform configured to support a pitcher performing an underhanded pitch comprising a generally T-shaped end having a raised pitchers rubber configured to support a drive foot of the pitcher during delivery of the underhanded pitch, and a pair of removable heel guides to inhibit rotation of the drive foot;

a stride section, removably connected to and positioned to extend longitudinally from said generally T-shaped end, said stride section having a goal post assembly to position a stride bar across said stride section, wherein said stride bar is generally J-shaped and extends vertically from a mounting bracket and has a flexible rod whip portion that extends laterally across said stride section.

2. The pitch training device of claim 1, wherein said platform further comprises an underside having a plurality of platform support members configured to support the platform.

3. The pitch training device of claim 1, wherein said stride bar is adjustable axially along the length of said stride section to accommodate pitchers of different leg length.

4. The pitch training device of claim 1, wherein said goal post assembly is comprised of a semi-circular toothed disc, a mounting bracket and said stride bar.

5. The pitch training device of claim 4, wherein said stride bar is rotatably seated in the mounting bracket, with a fastening clip hooked into female serrations of said semi-circular toothed disc.

6. The pitch training device of claim 5, wherein said stride bar is positioned at a target height and distance from said pitching rubber to force the user's stride foot to elevate while performing the underhanded pitch to improve the user's power generation of the underhanded pitch.

7. The pitch training device of claim 6, wherein said mounting bracket has a spring latch that enables removal and replacement of said stride bar.

8. The pitch training device of claim 1, wherein said platform configured from materials that provide a grip for said drive foot and said stride foot.

9. The pitch training device of claim 1, wherein said materials that provide a grip for said drive foot and said stride foot are petroleum based.

10. The pitch training device of claim 1, wherein said stride section consists of three identical sections, which are detachable and fasten to each other and to said T-shaped end through a connector.

11. The pitch training device of claim 10, wherein said connector has raised nubs and said T-shaped end and said stride section have bottom thru-holes that mate with said raised nubs of said connector to allow for removably connecting said T-shaped end to said stride section.

12. The pitch training device of claim 11, wherein said connector has thru-holes and said T-shaped end and said stride section have bottom raised nubs that mate with thru-holes of said connector to allow for removably connecting said T-shaped end to said stride section.

13. The pitch training device of claim 1, wherein the removable heel guides are conformed to mate with an approximately ½" tall pitching rubber positioned on the platform underneath the heel guides.

14. The pitch training device of claim 1, wherein said goal post assembly has bottom raised nubs that mate with thru-holes of said stride section to allow for removably connecting said goal post assembly to said stride section.

15. The pitch training device of claim 14, wherein said stride section has bottom raised nubs that mate with thru-holes goal post assembly of said to allow for removably connecting said goal post assembly to said stride section.

16. A pitch training device comprising:

a platform configured to support a pitcher performing a pitch comprising a generally T-shaped end having a raised pitchers rubber configured to support a drive foot of the pitcher during delivery of the pitch;

a stride section, removably connected to and positioned to extend longitudinally from said generally T-shaped end with a goal post assembly comprised of a semi-circular toothed disc, a mounting bracket and a stride bar.

17. The pitch training device of claim 16, wherein said raised pitchers rubber is mated with a pair of removable heel guides to inhibit rotation of the drive foot.

18. The pitch training device of claim 16, wherein the goal post assembly is configured to position the stride bar across said stride section.

* * * * *